US008012268B2

(12) United States Patent
Yoon et al.

(10) Patent No.: US 8,012,268 B2
(45) Date of Patent: Sep. 6, 2011

(54) DISHWASHER

(75) Inventors: Sang Heon Yoon, Seoul (KR); Nung Seo Park, Incheon (KR); Soung Bong Choi, Changwon-si (KR); Dae Yeong Han, Seoul (KR)

(73) Assignee: LG Electronics Inc., Seoul (KR)

( * ) Notice: Subject to any disclaimer, the term of this patent is extended or adjusted under 35 U.S.C. 154(b) by 536 days.

(21) Appl. No.: 11/061,740

(22) Filed: Feb. 22, 2005

(65) Prior Publication Data

US 2006/0086380 A1 Apr. 27, 2006

(30) Foreign Application Priority Data

Oct. 21, 2004 (KR) ..... 10-2004-0084416

(51) Int. Cl.
*B08B 3/02* (2006.01)

(52) U.S. Cl. ..... 134/56 D; 134/184; 134/198

(58) Field of Classification Search .... 68/15; 134/56 D, 134/108, 199, 184, 198, 200
See application file for complete search history.

(56) References Cited

U.S. PATENT DOCUMENTS

| | | | | |
|---|---|---|---|---|
| 1,511,661 | A | 10/1924 | Dantzebecher | |
| 1,590,470 | A | 6/1926 | Means | |
| 1,651,083 | A | 11/1927 | Brotz | |
| 1,946,181 | A | 2/1934 | Stoddard | |
| 1,995,633 | A | 3/1935 | Clark | |
| 2,002,300 | A | 5/1935 | Stoddard | |
| 2,023,013 | A * | 12/1935 | Faber et al. | 8/159 |
| 2,024,952 | A | 12/1935 | Snyder et al. | |
| 2,077,098 | A | 4/1937 | Dort | |
| 2,416,616 | A * | 2/1947 | Deutsch | 68/4 |
| 2,422,022 | A | 6/1947 | Koertge | |
| 2,437,968 | A | 3/1948 | Palotsee | |
| 2,571,438 | A | 10/1951 | Gerhardt et al. | |
| 2,656,702 | A | 10/1953 | Chapin | |
| 2,960,946 | A | 11/1960 | Lutz et al. | |
| 3,026,815 | A | 3/1962 | Jacobs | |
| 3,082,779 | A | 3/1963 | Jacobs | |
| 3,128,679 | A | 4/1964 | Trendle | |
| 3,179,307 | A | 4/1965 | Duncan et al. | |
| 3,310,243 | A | 3/1967 | Duncan et al. | |
| 3,333,443 | A * | 8/1967 | Kwangho et al. | 68/23 R |
| 3,333,742 | A | 8/1967 | La Flame | |

(Continued)

FOREIGN PATENT DOCUMENTS

CN 2384571 6/2000

(Continued)

OTHER PUBLICATIONS

European Patent Office 0 943 282 Sep. 1999.*

(Continued)

*Primary Examiner* — Frankie L Stinson
(74) *Attorney, Agent, or Firm* — McKenna Long & Aldridge LLP

(57) ABSTRACT

Dishwasher including a washing tub for placing dishes therein, a sump for accommodating washing water to wash the dishes in the washing tub, and a motor having a rotor and a stator, for generating pumping power to pump up the washing water from the sump to the washing tub, wherein the stator of the motor is wound in a concentrated winding type, thereby permitting effective utilization of the washing tub and the driving part room.

15 Claims, 2 Drawing Sheets

U.S. PATENT DOCUMENTS

| | | | | | |
|---|---|---|---|---|---|
| 3,355,111 | A | | 11/1967 | Barnstead | |
| 3,398,866 | A | | 8/1968 | La Flame et al. | |
| 3,406,637 | A | | 10/1968 | Perl | |
| 3,446,155 | A | | 5/1969 | Guth | |
| 3,503,228 | A | * | 3/1970 | Lake | 68/12.17 |
| 3,519,796 | A | | 7/1970 | Bebinger | |
| 3,560,823 | A | * | 2/1971 | Nystuen | 318/785 |
| 3,583,835 | A | | 6/1971 | Coburn et al. | |
| 3,587,939 | A | | 6/1971 | Nystuen | |
| 3,750,951 | A | * | 8/1973 | Perl | 239/139 |
| 3,868,835 | A | * | 3/1975 | Todd-Reeve | 68/20 |
| 3,918,479 | A | * | 11/1975 | Perl | 137/340 |
| 4,096,872 | A | * | 6/1978 | Herbst et al. | 134/105 |
| 4,221,547 | A | | 9/1980 | Hoffman et al. | |
| 4,602,176 | A | | 7/1986 | Baker | |
| 4,612,947 | A | | 9/1986 | Duncan | |
| 4,689,511 | A | | 8/1987 | Baker et al. | |
| 4,700,095 | A | | 10/1987 | Kawakami | |
| 4,741,353 | A | * | 5/1988 | Milocco | 137/119.03 |
| 5,118,254 | A | | 6/1992 | Ellingson et al. | |
| 5,150,589 | A | * | 9/1992 | Williams et al. | 68/23.7 |
| 5,264,043 | A | * | 11/1993 | Milocco | 134/25.2 |
| 5,331,986 | A | * | 7/1994 | Lim et al. | 134/88 |
| 5,470,142 | A | * | 11/1995 | Sargeant et al. | 312/258 |
| 5,620,014 | A | * | 4/1997 | Milocco et al. | 134/108 |
| 5,775,347 | A | * | 7/1998 | Hoover et al. | 134/56 D |
| 5,849,101 | A | * | 12/1998 | Edwards et al. | 134/18 |
| 5,918,360 | A | * | 7/1999 | Forbes et al. | 29/596 |
| 5,924,432 | A | * | 7/1999 | Thies et al. | 134/56 D |
| 5,931,029 | A | * | 8/1999 | Kim | 68/134 |
| 6,432,216 | B1 | * | 8/2002 | Thies | 134/18 |
| 6,510,716 | B1 | | 1/2003 | Kim et al. | |
| 6,601,593 | B2 | * | 8/2003 | Deiss et al. | 134/25.2 |
| 6,659,114 | B2 | * | 12/2003 | Bigott | 134/95.3 |
| 6,877,962 | B2 | | 4/2005 | Turner et al. | |
| 6,882,080 | B2 | * | 4/2005 | Tanaka et al. | 310/216.112 |
| 6,920,660 | B2 | | 7/2005 | Lam | |
| 7,318,850 | B2 | | 1/2008 | Kaylan et al. | |
| 7,337,790 | B2 | | 3/2008 | Ha | |
| 2004/0084985 | A1 | | 5/2004 | Hasumi | |
| 2004/0090138 | A1 | | 5/2004 | Amrhein et al. | |
| 2004/0119374 | A1 | * | 6/2004 | Carl et al. | 310/268 |
| 2004/0155548 | A1 | | 8/2004 | Rasmussen | |
| 2005/0211278 | A1 | * | 9/2005 | Favaro et al. | 134/56 D |

FOREIGN PATENT DOCUMENTS

| | | | | |
|---|---|---|---|---|
| CN | 2558153 | | | 6/2003 |
| DE | 2 328 655 | A1 | | 6/1974 |
| DE | 2 743 826 | A | | 4/1978 |
| DE | 36 38 228 | | * | 5/1987 |
| DE | 19645531 | A1 | | 11/1996 |
| EP | 0 260 501 | | | 3/1988 |
| EP | 0 750 064 | | | 12/1996 |
| GB | 1153147 | | | 5/1969 |
| GB | 1 406 155 | | | 9/1975 |
| GB | 2 221 384 | | * | 7/1990 |
| JP | 60-092797 | | | 5/1985 |
| JP | 60225594 | A | | 11/1985 |
| JP | 63-194697 | A | | 8/1988 |
| JP | 02215496 | A | | 8/1990 |
| JP | 02-257992 | | | 10/1990 |
| JP | 04058995 | A2 | | 2/1992 |
| JP | 05-164451 | | | 6/1993 |
| JP | 10165690 | A | | 6/1998 |
| JP | 10174396 | A | | 6/1998 |
| JP | 11-308793 | A | | 11/1999 |
| JP | 113000081 | A | | 11/1999 |
| JP | 2001-178030 | | * | 6/2001 |
| JP | 2001218436 | A | | 8/2001 |
| JP | 2002315715 | A | | 10/2002 |
| JP | 2004-049611 | | | 2/2004 |
| JP | 2004-60620 | | * | 2/2004 |
| JP | 2004121320 | A | | 4/2004 |
| JP | 2004-49611 | | * | 2/2005 |
| KR | 1020000009782 | A | | 7/1998 |
| KR | 10-0267921 | | | 12/2000 |
| KR | 20-0272543 | | | 4/2002 |
| KR | 2003-0076286 | | | 9/2003 |
| WO | WO 03/053211 | | | 7/2003 |

OTHER PUBLICATIONS

Written Decision issued by U.S. Patent Court on Aug. 19, 2008.

Exhibit No. Eul-2-1,2, Specification of DWA-2201H, Jan. 10, 2008.

Exhibit No. Eul-3-1,2, Specification of PDW-603FC, Jan. 10, 2008.

* cited by examiner

DISHWASHER

CROSS-REFERENCE TO RELATED APPLICATION

This application claims the benefit of Korean Application No. P2004-0084416 filed on Oct. 21, 2004, which is hereby incorporated by reference as if fully set forth herein.

BACKGROUND OF THE INVENTION

1. Field of the Invention

The present invention relates to dishwashers, and more particularly, to a dishwasher which enables an effective utilization of a washing tub space wherein dishes are placed.

2. Discussion of the Related Art

A related art dishwasher will be described with reference to FIG. 1.

The dishwasher 1 sprays washing water to dishes, for washing the dishes. The dishwasher 1 is provided with a washing tub 3 for placing and washing the dishes, and a portion 5 (hereafter called as "driving part room") under the washing tub for mounting various electric components for supplying high pressure washing water to the washing tub 3.

The washing tub 3 and the driving part room 5 will be described.

On the front of the washing tub 3, there is a door 7 for opening/closing the washing tub 3. Inside of the washing tub 3, there are an upper rack 12 and a lower rack 14, for placing the dishes thereon, and under the upper rack 12 and the lower rack 14, there are an upper arm 32, and a lower arm 34 for spraying the washing water respectively. There is a heater 13 under the washing tub for heating the washing water to a predetermined temperature.

In the meantime, in the driving part room 5, there are a sump 9, with a washing pump mounted thereon for pumping up the washing water from the sump 9 to the upper arm 32 and the lower arm 34 in the washing tub 3. In general, the sump 9 is connected to the upper arm 32 and the lower arm 34 with an upper pipe 322 and a lower pipe 324, respectively.

In general, the washing pump is provided with a motor 11 for generating driving force, and an impeller (not shown) coupled to the motor 11. The motor 11 is mounted on the side of the sump 9. That is, the motor 100 has a shaft arranged substantially perpendicular to a height direction of the dishwasher.

The operation of the related art dishwasher will be described.

Upon operating the dishwasher, the washing pump pumps up the washing water from the sump 9 to the upper arm 32 and/or the lower arm 34 in the washing tub 3. According to this, the washing water is sprayed from the upper arm 32 and the lower arm 34 to the dishes on the upper rack 12 and/or the lower rack 14, to wash the dishes. The washing water may be supplied to the upper arm 32 or the lower arm 34, singly, or at the same time.

The washing water sprayed to the dishes returns to the sump 9 through recovery holes (not shown) in communication with the sump 9. The washing water containing contaminants due to washing dishes may be filtered through a filtering means.

However, the related art dishwasher has a problem in that a size of the driving part room 5 is large so as to impede effective utilization of a height or a space of the washing tub 3. The reason will be described.

First, in the related art dishwasher, as the motor for the washing pump, a general induction motor is used as it is. The general induction motor has a large size, i.e., has great height 'H', and diameter 'D'. Therefore, due to the size of the induction motor, the height, or size of the driving part room becomes large, to impair space utilization of the washing tub 3.

Second, in the related art dishwasher, the heater 13 is mounted under the washing tub 3. That is, the heater 13 is mounted between the lower arm 34 and a bottom of the washing tub 3. Thus, a space between the lower arm 34 and the bottom of the washing tub 3 for mounting the heater 13 is needed. This space can be utilized as a space of the washing tub 3, otherwise.

SUMMARY OF THE INVENTION

Accordingly, the present invention is directed to a dishwasher that substantially obviates one or more problems due to limitations and disadvantages of the related art.

An object of the present invention is to provide a dishwasher which enables effective utilization of the washing tub.

Another object of the present invention is to provide a dishwasher which enables effective utilization of a driving part room.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dishwasher includes a washing tub for placing dishes therein, a sump for accommodating washing water to wash the dishes in the washing tub, and a motor having a rotor and a stator, for generating pumping power to pump up the washing water from the sump to the washing tub, wherein the stator of the motor is wound in a concentrated winding type.

Preferably, the motor has a diameter greater than a height for providing a required output. Preferably, the motor is of an outer rotor type. Preferably, the motor is a speed controllable motor.

Preferably, the motor is a DC motor, and more preferably, a brushless DC motor.

The sump has a heater mounted thereon for heating the washing water.

The washing tub has an upper arm and a lower arm mounted therein, and the washing water is supplied to the upper arm and the lower arm alternatively, not at the same time. Preferably, the motor has an increased rotation speed when the washing water is supplied only to the upper arm.

In another aspect of the present invention, a dishwasher includes a washing tub for placing dishes therein, a sump for accommodating washing water to wash the dishes in the washing tub, and a motor having a rotor and a stator, for generating pumping power to pump up the washing water from the sump to the washing tub, wherein the motor has a diameter greater than a height, for providing a required output.

In another aspect of the present invention, a dishwasher includes a washing tub for placing dishes therein, a sump for accommodating washing water to wash the dishes in the washing tub, and a motor having a rotor and a stator, for generating pumping power to pump up the washing water from the sump to the washing tub, wherein the motor is of an outer rotor type.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
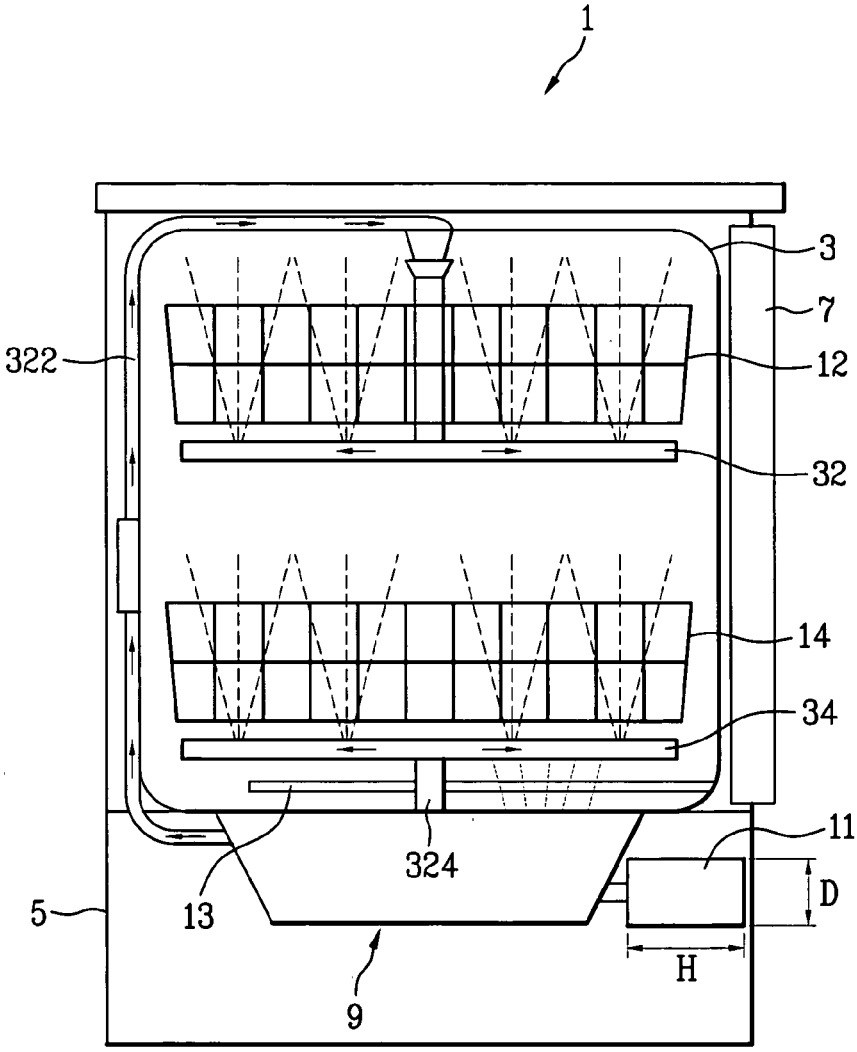
FIG. 1 Related Art
FIG. 1 illustrates a longitudinal section of a related art dishwasher, schematically.
Figure 2:
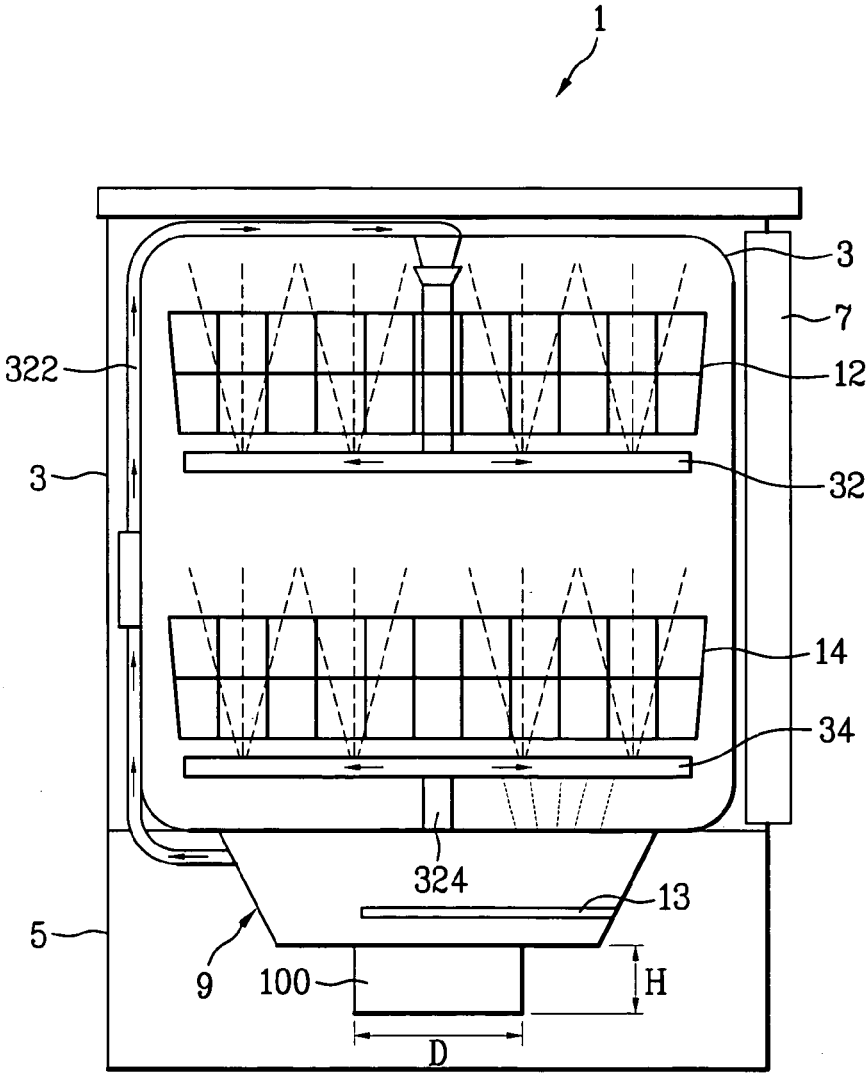
FIG. 2 illustrates a longitudinal section of a dishwasher in accordance with a preferred embodiment of the present invention, schematically.

Reference will now be made in detail to the preferred embodiments of the present invention, examples of which are illustrated in the accompanying drawing FIG. 2. Wherever possible, the same reference numbers will be used throughout the drawings to refer to the same or like parts.

Alike the related art, the dishwasher 1 of the present invention also includes a washing tub 3, and a driving part room 5, and the driving part room 5 has a sump 9 and a washing pump motor 100 mounted therein. However, different from the related art dishwasher, the dishwasher of the present invention has a heater 13 mounted on the sump 9. Moreover, the washing pump motor 100 is different from the related art one. The details are as follows.

In order to utilize a space, more specifically, a height of the washing tub 3, the inventor finds out a method for reducing the height of the motor 100. That is, in the related art, there have been no attempts for reducing the height of the motor 100 for effective utilization of a space of the washing tub 3 of the dishwasher. However, the inventor noticed that, if a motor 100 having a smaller height, but having the same output, is used, the height of the driving part room can be reduced, and utilization as much as the space as a space of the washing tub 3 is possible.

The method for reducing the height of the motor 100 while an output of the motor is maintained will be described in detail.

The inventor changes a winding type of the motor 100 to reduce the height of the motor 100. That is, the winding type is improved so that the motor 100 has a reduced height while the motor has the same output. That is, the related art dishwasher uses the general induction motor 100 as it is, which has a great height because, in general, the induction motor 100 uses a distributed winding.

Therefore, the height of the motor 100 is reduced by using a concentrated winding instead of the distributed winding. That is, if the concentrated winding is used instead of the distributed winding, the height of the motor 100 can be reduced while the output of the motor 100 is maintained. In detail, the motor has a rotor and a stator, and the stator has a core, and coils wound on the core. That is, if the winding type of the coil on the core is changed from the distributed type to the concentrated type, the height of the motor 100 can be reduced while the output of the motor 100 is maintained the same.

In the meantime, regardless of the winding type, the relation between the height 'H' and the diameter 'D' of the motor 100 could be adjusted so as to reduce the height of the motor 100 with the same output of the motor 100. Since a magnetic flux, which is one of the factors related to the motor output, is proportional to a sectional area of the stator (mainly core of the stator) of the motor 100, the decreased height and the increased diameter of the stator could lead the same or greater sectional area of the stator and thus could lead the same or greater output of the motor 100. Also, if the height of the stator is reduced, the height of the motor 100 is also reduced. Accordingly, comparing with the related art dishwashers, it is possible to achieve the motor having the same or greater output by decreasing the height 'H' of the motor and increasing the diameter 'D' of the motor 100. In addition, utilization of the driving part room 5 in view of width rather than height is preferable.

In summary, it is possible to reduce the height 'H' of the motor 100 by increasing the diameter 'D' of the motor 100 in order to make the motor having a required output. In order words, the motor according to this invention has a relatively large diameter and a relatively short height' with the same or greater output, comparing with the height and the diameter of the related art dishwashers.

In the meantime, if a type of the motor 100 is changed from an inner rotor type to an outer rotor type, the height of the motor 100 can be reduced. That is, because the outer rotor type motor has the stator on an inner side of the rotor, the size of the core and the length of the winding can be reduced, leading to reduce the height 'H' of the motor 100 in overall. Moreover, in general, since, compared to the inner rotor type motor, the outer rotor type motor can increase the motor output, the number of the windings and the size of the core could be smaller than the inner rotor type motor having the same output and thus the height of the motor 100 could be reduced as well.

In summary, there are several ways to reduce the height 'H' of the motor without dropping the output of the motor 100. The winding type of the motor could be changed to the concentrated winding type. Also, the diameter of the motor could be relatively greater and the height of the motor could be relatively reduced, regardless of the winding type of the motor. Also, the type of the motor could be made to be the outer rotor type, regardless of the winding type of the motor. Of course, if the outer rotor type is used, the diameter of core is increased, the height of the motor is reduced, and the concentrated type winding is used, the height of the motor 100 can be reduced more effectively.

Any motor 100 in accordance with the above mentioned ways can be used to reduce the height of the motor. However, it is preferable to use a DC motor instead of the related art induction motor. It is more preferable to use a brushless DC motor.

In the meantime, as described, if the height 'H' of the motor 100 is reduced, the shaft of the motor 100 can be arranged parallel to the height direction of the washing tub 3, i.e., the motor 100 can be mounted vertically. This configuration enables more effective utilization of a side space of the sump 9.

A dishwasher in accordance with another preferred embodiment of the present invention will be described.

In this embodiment, the height 'H' of the motor 100 can be reduced even if the related art induction motor is used as it is.

That is, the output of the motor itself is reduced by changing a method for controlling the dishwasher, for reducing the height 'H' of the motor 100.

It will be described in detail. For an example, in the related art dishwasher, the washing water is supplied only to the upper arm 32 if the dishes are only on the upper rack 12, and the washing water is supplied only to the lower arm 34 if the dishes are only on the lower rack 14. The washing water is supplied to both the upper arm 32 and the lower arm 34 at the same time, if the dishes are on both the upper rack 12 and the lower rack 14. Therefore, the output of the motor 100 is designed to supply the washing water to both the upper arm 32 and the lower arm 34 at the same time. However, according to experiments of the inventor, even in case that the dishes are on both the upper rack 12 and the lower rack 14, it is possible to wash the dishes well by supplying the washing water to the upper rack 12 and the lower rack 14 alternately at fixed time intervals, not at the same time. Therefore, the required output of the motor 100 could be reduced by controlling the dishwasher to supply the washing water to the upper arm 32 or the lower arm 34 alternately, not simultaneously. Accordingly, the required output of the motor 100 could be reduced and thus the motor 100 itself could be reduced. This means that the height 'H' of the motor 100 could be reduced as well. In this instance, it is preferable that the output of the motor 100 is adjusted such that the washing water is effectively supplied to the upper arm instead of the lower arm.

Another embodiment of the present invention will be described.

In the embodiment, a mounting position of the heater 13 is changed, for increasing a height of the washing tub 3. That is, besides changing the motor 100, by changing the mounting position of the heater 13, an actual space of the washing tub 3 can be made larger.

Since the heater 13 of this invention is mounted in the sump 9 for heating the washing water, the actual space of the washing tub 3 is larger. Thus, the space between the lower arm 34 and the washing tub 3 used for mounting the heater 13 in the related art dishwashers can be utilized as a space of the washing tub 3 in this invention.

The operation of the dishwasher of the present invention will be described.

Upon putting the dishwasher into operation, the washing water in the sump 9 is heated by the heater 13, and pumped up by the washing pump. The washing water pumped up thus is supplied to the upper arm 32, and/or the lower arm 34 in the washing tub 3 by a flow passage control valve (not shown), selectively. In this instance, as described above, it is preferable that the washing water is supplied to both the upper arm 32 and the lower arm 34, not at the same time, but alternately at fixed time intervals. The washing water sprayed to the dishes returns to the sump 9 again through recovery holes in communication with the sump 9. The washing water, having washed the dishes to contain contaminants, may be filtered through predetermined filtering means.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

As has been described, the dishwasher of the present invention has the following advantages.

First, the reduction of the motor height to reduce a height of the driving part room and increase a height of the washing tub permits to utilize the washing tub effectively. Moreover, the mounting of the heater in the driving part room, i.e., in the sump also permits an effective utilization of the washing tub space.

Second, the reduction of the motor height permits effective utilization of the driving part room.

What is claimed is:

1. A dishwasher comprising:

a washing tub for placing dishes therein;

a sump for accommodating washing water to wash the dishes in the washing tub; and a motor having a rotor and a stator, for generating pumping power to pump up the washing water from the sump to the washing tub, wherein the motor is of an outer rotor type and has a greater diameter than a height for providing a required output;

wherein the stator of the motor is wound in a concentrated winding type and further a dishwasher control wherein the output of the motor is adjusted such that washing water is effectively supplied to an upper arm of the dishwasher or a lower arm of the dishwasher alternately instead of simultaneously, and a heater is mounted in the sump such that the washing space is maximized.

2. The dishwasher as claimed in claim 1, wherein the motor is a speed controllable motor.

3. The dishwasher as claimed in claim 1, wherein the motor is a DC motor.

4. The dishwasher as claimed in claim 3, wherein the motor is a brushless DC motor.

5. The dishwasher as claimed in claim 1, wherein the sump has a heater mounted thereon for heating the washing water.

6. The dishwasher as claimed in claim 1, wherein the upper arm and lower arm are mounted in the washing tub.

7. The dishwasher as claimed in claim 6, wherein the motor has an increased rotation speed when the washing water is supplied only to the upper arm.

8. A dishwasher comprising:

a washing tub for placing dishes therein;

a sump for accommodating washing water to wash the dishes in the washing tub; and a motor having a rotor and a stator, for generating pumping power to pump up the washing water from the sump to the washing tub, wherein the stator of the motor has a diameter greater than a height, for providing a required output and further a dishwasher control wherein the output of the motor is adjusted such that washing water is effectively supplied to an upper arm of the dishwasher or a lower arm of the dishwasher alternately instead of simultaneously, and a heater is mounted in the sump such that the washing space is maximized.

9. The dishwasher as claimed in claim 8, wherein the sump has a heater mounted therein for heating the washing water.

10. The dishwasher as claimed in claim 8, wherein the upper arm and lower arm are mounted in the washing tub.

11. The dishwasher as claimed in claim 10, wherein the motor has an increased rotation speed when the washing water is supplied only to the upper arm.

12. A dishwasher comprising:

a washing tub for placing dishes therein;

a sump for accommodating washing water to wash the dishes in the washing tub; and a motor having a rotor and a stator, for generating pumping power to pump up the washing water from the sump to the washing tub, wherein the motor is of an outer rotor type and further a dishwasher control wherein the output of the motor is adjusted such that washing water is effectively supplied to an upper arm of the dishwasher or a lower arm of the dishwasher alternately instead of simultaneously, and a heater is mounted in the sump such that the washing space is maximized.

13. The dishwasher as claimed in claim 12, wherein the sump has a heater mounted therein for heating the washing water.

14. The dishwasher as claimed in claim 12, wherein the upper arm and lower arm are mounted in the washing tub.

15. The dishwasher as claimed in claim 14, wherein the motor has an increased rotation speed when the washing water is supplied only to the upper arm.

* * * * *